US012084161B2

(12) United States Patent
Morimoto et al.

(10) Patent No.: US 12,084,161 B2
(45) Date of Patent: Sep. 10, 2024

(54) SYSTEM FOR AND METHOD OF CONTROLLING WATERCRAFT

(71) Applicant: YAMAHA HATSUDOKI KABUSHIKI KAISHA, Iwata (JP)

(72) Inventors: Yuki Morimoto, Shizuoka (JP); Yuji Ikegaya, Shizuoka (JP); Yoshikazu Nakayasu, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 400 days.

(21) Appl. No.: 17/523,980

(22) Filed: Nov. 11, 2021

(65) Prior Publication Data

US 2022/0177096 A1 Jun. 9, 2022

(30) Foreign Application Priority Data

Dec. 9, 2020 (JP) ..... 2020-203882

(51) Int. Cl.

| | |
|---|---|
| ***B63H 5/08*** | (2006.01) |
| ***B63H 5/125*** | (2006.01) |
| ***B63H 20/00*** | (2006.01) |
| ***B63H 21/17*** | (2006.01) |
| ***B63H 21/21*** | (2006.01) |
| ***B63H 25/02*** | (2006.01) |
| ***B63H 25/42*** | (2006.01) |

(52) U.S. Cl.

CPC ..... *B63H 5/08* (2013.01); *B63H 5/125* (2013.01); *B63H 21/17* (2013.01); *B63H 21/21* (2013.01); *B63H 25/02* (2013.01); *B63H 25/42* (2013.01); *B63H 2020/003* (2013.01); *B63H 2021/216* (2013.01); *B63H 2025/425* (2013.01)

(58) Field of Classification Search

CPC ..... B63H 25/02; B63H 5/08; B63H 21/213
USPC ..... 701/21
See application file for complete search history.

(56) References Cited

U.S. PATENT DOCUMENTS 9,039,468 B1 * 5/2015 Arbuckle ..... B63H 25/04 440/79
9,733,645 B1 * 8/2017 Andrasko ..... B63H 25/02
(Continued)

FOREIGN PATENT DOCUMENTS

EP 1926658 A1 * 6/2008 ..... B63H 21/213
JP 2020-168921 A 10/2020

*Primary Examiner* — Todd Melton
*Assistant Examiner* — Vincent Feng
(74) *Attorney, Agent, or Firm* — Keating & Bennett, LLP

(57) ABSTRACT

A controller for a watercraft controls first and second marine propulsion devices to start moving the watercraft by setting a first default angle, a second default angle, and a default thrust ratio as a first target rudder angle, a second target rudder angle, and a target thrust ratio respectively when a desired motion of the watercraft is straight sideways movement. The controller determines at least one of a first correcting angle, a second correcting angle, and a correcting thrust ratio to reduce an error between the straight sideways movement of the watercraft and an actual motion of the watercraft. The controller corrects the first target rudder angle, the second target rudder angle, and the target thrust ratio with the first correcting angle, the second correcting angle, and the correcting thrust ratio, respectively. The controller repeatedly detects the error and repeatedly updates the correcting angles and the correcting thrust ratio.

18 Claims, 10 Drawing Sheets

(56) References Cited

U.S. PATENT DOCUMENTS

| | | | | |
|---|---|---|---|---|
| 9,988,134 | B1 * | 6/2018 | Gable | B63B 79/40 |
| 2007/0089660 | A1 * | 4/2007 | Bradley | B63H 21/22<br>114/144 A |
| 2010/0116190 | A1 * | 5/2010 | Ito | B63H 20/12<br>114/144 RE |
| 2017/0305520 | A1 * | 10/2017 | Watanabe | B63H 25/42 |
| 2020/0331578 | A1 | 10/2020 | Sakashita et al. | |

* cited by examiner

SYSTEM FOR AND METHOD OF CONTROLLING WATERCRAFT

CROSS REFERENCE TO RELATED APPLICATIONS

This application claims the benefit of priority to Japanese Patent Application No. 2020-203882 filed on Dec. 9, 2020. The entire contents of this application are hereby incorporated herein by reference.

BACKGROUND OF THE INVENTION

1. Field of the Invention

The present invention relates to a system for and a method of controlling a watercraft.

2. Description of the Related Art

There has been conventionally known a type of system for controlling a marine propulsion device to move a watercraft sideways. For example, a system disclosed in Japan Laid-open Patent Application Publication No. 2020-168921 controls a first outboard motor and a second outboard motor to move a watercraft sideways in response to operating an operating lever. When the operating lever is tilted sideways, the system controls the rudder angle and the magnitude of thrust of each first/second outboard motor such that a net force of the thrusts of the first and second outboard motors is oriented sideways.

In such a system for moving a watercraft sideways as described above, a calibration work is performed for aligning an actual moving direction of the watercraft with a moving direction of the watercraft instructed by the operating lever. In the calibration work, when the operating lever is tilted sideways, the system recognizes displacement between the actual moving direction of the watercraft and the instructed sideways direction. The system computes correction amounts for canceling out the displacement.

In such a system as described above, the correction amounts computed in the calibration work are stored for future use. The rudder angle and the amount of thrust of each first/second outboard motor, obtained in tilting the operating lever sideways, are corrected with the correction amounts. The system keeps the correction amounts stored even after shutdown. When then rebooted, the system corrects the rudder angle and the magnitude of thrust of each first/second outboard motor with the stored correction amounts.

However, external forces attributed to external factors (tide, wind, etc.) act on a watercraft. The external forces attributed to the external factors are not constant but variable with time or the position of the watercraft. Therefore, even when the rudder angle and the magnitude of thrust of each outboard motor are corrected in such a calibration work as described above, the actual moving direction of the watercraft is inevitably displaced from the instructed sideways direction with changes in the external forces attributed to the external factors. Because of this, it is not easy to stably move the watercraft sideways.

SUMMARY OF THE INVENTION

Preferred embodiments of the present invention stably move a watercraft sideways in response to operating an operator sideways.

A system according to a first preferred embodiment of the present invention controls a watercraft. The system includes a first marine propulsion device, a second marine propulsion device, an operator, and a controller. The first marine propulsion device is rotatable about a first steering shaft. The second marine propulsion device is rotatable about a second steering shaft. The operator is manually operable and outputs an operating signal indicating a desired motion of the watercraft. The controller is configured or programmed to determines a first target rudder angle of the first marine propulsion device, a second target rudder angle of the second marine propulsion device, and a target thrust ratio in accordance with the operating signal. The target thrust ratio is set as a ratio of magnitude between a first thrust generated by the first marine propulsion device and a second thrust generated by the second marine propulsion device. The controller is configured or programmed to control the first marine propulsion device and the second marine propulsion device based on the first target rudder angle, the second target rudder angle, and the target thrust ratio such that the watercraft performs the desired motion thereof. The controller is configured or programmed to store a first default angle, a second default angle, and a default thrust ratio in association with the first target rudder angle, the second target rudder angle, and the target thrust ratio respectively. The first default angle, the second default angle, and the default thrust ratio have been preliminarily set such that a net thrust of the first thrust and the second thrust is oriented straight sideways and extends from a center of gravity of the watercraft. When the desired motion is straight sideways movement, the controller is configured or programmed to control the first marine propulsion device and the second marine propulsion device to start moving the watercraft by setting the first default angle, the second default angle, and the default thrust ratio as the first target rudder angle, the second target rudder angle, and the target thrust ratio respectively. The controller is configured or programmed to detect an error between the straight sideways movement of the watercraft and an actual motion of the watercraft. The controller is configured or programmed to determine at least one of a first correcting angle, a second correcting angle, and a correcting thrust ratio so as to reduce the error. The controller is configured or programmed to correct the first target rudder angle, the second target rudder angle, and the target thrust ratio with the first correcting angle, the second correcting angle, and the correcting thrust ratio respectively. The controller repeatedly detects the error and repeatedly updates the first correcting angle, the second correcting angle, and the correcting thrust ratio in accordance with the error.

A method according to a second preferred embodiment of the present invention controls a watercraft including a first marine propulsion device and a second marine propulsion device. The first marine propulsion device is rotatable about a first steering shaft. The second marine propulsion device is rotatable about a second steering shaft. The method includes receiving an operating signal from an operator that is manually operable to output the operating signal indicating a desired motion of the watercraft; determining a first target rudder angle of the first marine propulsion device, a second target rudder angle of the second marine propulsion device, and a target thrust ratio, which is set as a ratio of magnitude between a first thrust generated by the first marine propulsion device and a second thrust generated by the second marine propulsion device, in accordance with the operating signal and controlling the first marine propulsion device and the second marine propulsion device based on the first target rudder angle, the second target rudder angle, and the target thrust ratio such that the watercraft performs the desired motion thereof; retrieving a first default angle, a second default angle, and a default thrust ratio that are stored in association with the first target rudder angle, the second target rudder angle, and the target thrust ratio respectively and have been preliminarily set such that a net thrust of the first thrust and the second thrust is oriented straight sideways and extends from a center of gravity of the watercraft; controlling the first marine propulsion device and the second marine propulsion device to start moving the watercraft by setting the first default angle, the second default angle, and the default thrust ratio as the first target rudder angle, the second target rudder angle, and the target thrust ratio respectively when the desired motion is straight sideways movement; detecting an error between the straight sideways movement of the watercraft and an actual motion of the watercraft; determining at least one of a first correcting angle, a second correcting angle, and a correcting thrust ratio so as to reduce the error; correcting the first target rudder angle, the second target rudder angle, and the target thrust ratio with the first correcting angle, the second correcting angle, and the correcting thrust ratio respectively; and repeatedly detecting the error and repeatedly updating the first correcting angle, the second correcting angle, and the correcting thrust ratio.

A system according to a third preferred embodiment of the present invention controls a watercraft. The system includes a first marine propulsion device, a second marine propulsion device, an operator, and a controller. The first marine propulsion device is rotatable about a first steering shaft. The second marine propulsion device is rotatable about a second steering shaft. The operator is manually operable and outputs an operating signal indicating a desired motion of the watercraft. The controller is configured or programmed to determine a first target rudder angle of the first marine propulsion device, a second target rudder angle of the second marine propulsion device, a first target thrust, and a second target thrust in accordance with the operating signal. The first target thrust indicates a target magnitude of a first thrust generated by the first marine propulsion device. The second target thrust indicates a target magnitude of a second thrust generated by the second marine propulsion device. The controller controls the first marine propulsion device and the second marine propulsion device based on the first target rudder angle, the second target rudder angle, the first target thrust, and the second target thrust such that the watercraft performs the desired motion. The controller is configured or programmed to store a first default angle and a second default angle in association with the first target rudder angle and the second target rudder angle respectively. The first default angle and the second default angle have been preliminarily set such that a net thrust of the first thrust and the second thrust is oriented straight sideways and extends from a center of gravity of the watercraft. When the desired motion is straight sideways movement, the controller is configured or programmed to control the first marine propulsion device and the second marine propulsion device to start moving the watercraft by setting the first default angle and the second default angle as the first target rudder angle and the second target rudder angle respectively. The controller is configured or programmed to detect an error between the straight sideways movement of the watercraft and an actual motion of the watercraft. The controller is configured or programmed to determine at least one of a first correcting angle, a second correcting angle, a first correcting thrust, and a second correcting thrust so as to reduce the error. The controller corrects the first target rudder angle, the second target rudder angle, the first target thrust, and the second target thrust with the first correcting angle, the second correcting angle, the first correcting thrust, and the second correcting thrust respectively. The controller repeatedly detects the error and repeatedly updates the first correcting angle, the second correcting angle, the first correcting thrust, and the second correcting thrust in accordance with the error.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
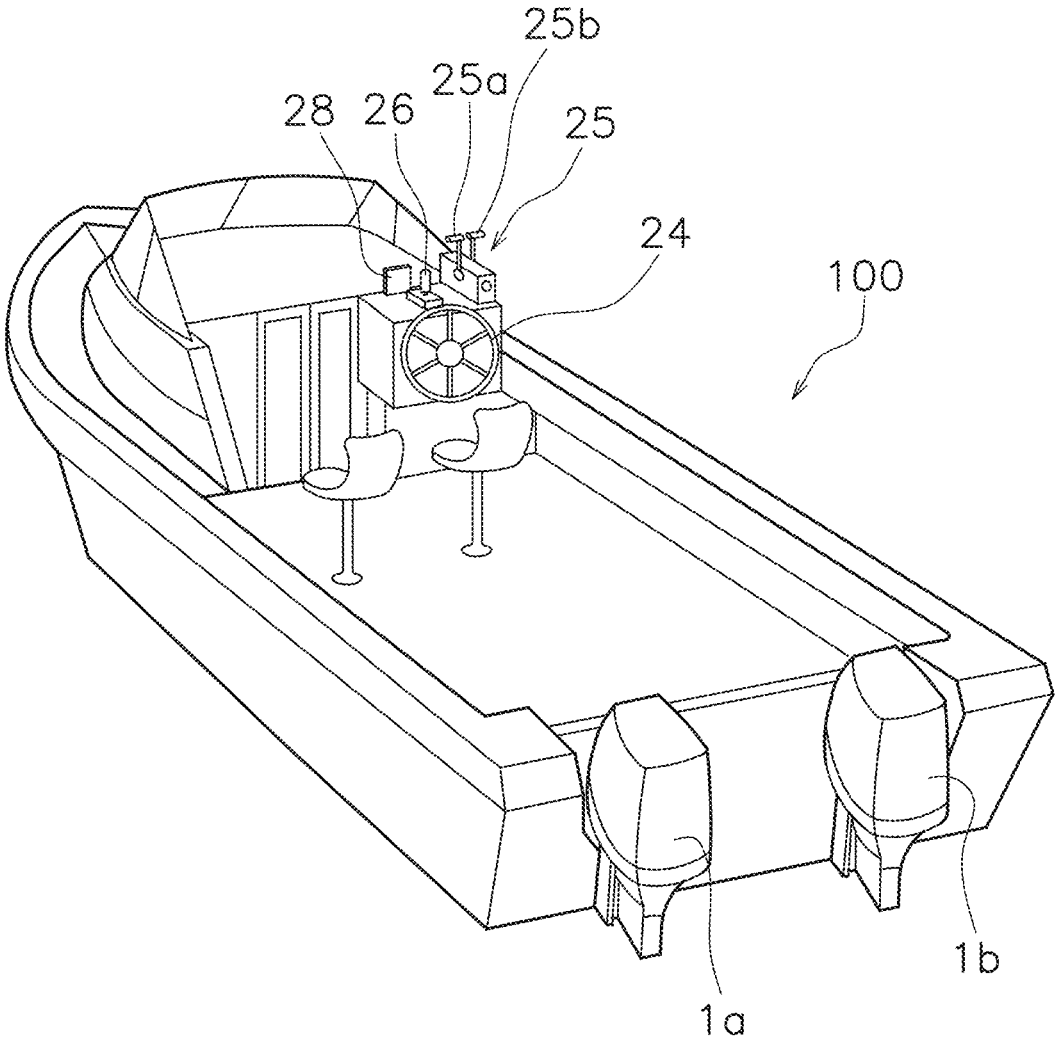
FIG. 1 is a perspective view of a watercraft to which marine propulsion devices according to a preferred embodiment of the present invention are mounted.

Preferred embodiments of the present invention will be hereinafter explained with reference to drawings. FIG. 1 is a perspective view of a watercraft 100 to which a plurality of marine propulsion devices according to a preferred embodiment of the present invention are mounted. Marine propulsion devices 1*a* and 1*b* are mounted to the watercraft 100 as the plural marine propulsion devices. In the present preferred embodiment, the marine propulsion devices 1*a* and 1*b* preferably are outboard motors, for example.

The marine propulsion devices 1*a* and 1*b* are attached to the stern of the watercraft 100. The marine propulsion devices 1*a* and 1*b* are disposed in alignment in a width direction of the watercraft 100. Specifically, the first marine propulsion device 1*a* is disposed on the port side of the watercraft 100. The second marine propulsion device 1*b* is disposed on the starboard side of the watercraft 100. Each marine propulsion device 1*a*, 1*b* generates a thrust to propel the watercraft 100.

Figure 2:
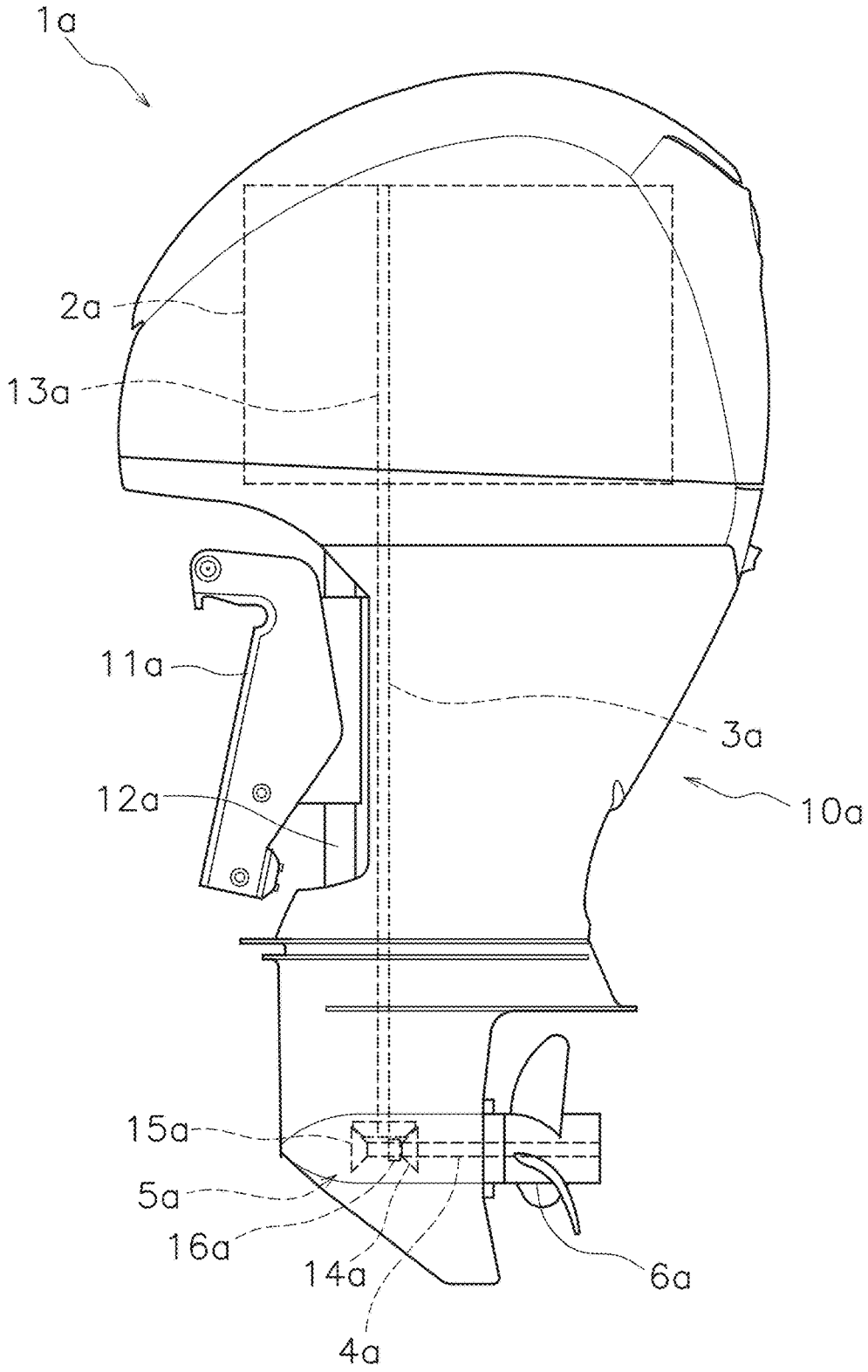
FIG. 2 is a side view of one of the marine propulsion devices.

FIG. 2 is a side view of the first marine propulsion device 1*a*. The first marine propulsion device 1*a* is attached to the watercraft 100 through a bracket 11*a*. The bracket 11*a* supports the first marine propulsion device 1*a* such that the first marine propulsion device 1*a* is rotatable about a first steering shaft 12*a*. The first steering shaft 12*a* extends in an up-and-down direction of the first marine propulsion device 1*a*.

The first marine propulsion device 1*a* includes a first drive unit 2*a*, a drive shaft 3*a*, a propeller shaft 4*a*, a first shift mechanism 5*a*, and a housing 10*a*. The first drive unit 2*a* generates the thrust to propel the watercraft 100. The first drive unit 2*a* is an internal combustion engine, for example. The first drive unit 2*a* includes a crankshaft 13*a*. The crankshaft 13*a* extends in the up-and-down direction of the first marine propulsion device 1*a*. The drive shaft 3*a* is connected to the crankshaft 13*a*. The drive shaft 3*a* extends in the up-and-down direction of the first marine propulsion device 1*a*. The propeller shaft 4*a* extends in a back-and-forth direction of the first marine propulsion device 1*a*. The propeller shaft 4*a* is connected to the drive shaft 3*a* through the first shift mechanism 5*a*. A propeller 6*a* is attached to the propeller shaft 4*a*.

The first shift mechanism 5*a* includes a forward moving gear 14*a*, a rearward moving gear 15*a*, and a dog clutch 16*a*. When gear engagement of each gear 14*a*, 15*a* is switched by the dog clutch 16*a*, the direction of rotation transmitted from the drive shaft 3*a* to the propeller shaft 4*a* is switched. Movement of the watercraft 100 is thus switched between forward movement and rearward movement. The housing 10*a* accommodates the first drive unit 2*a*, the drive shaft 3*a*, the propeller shaft 4*a*, and the first shift mechanism 5*a*.

Figure 3:
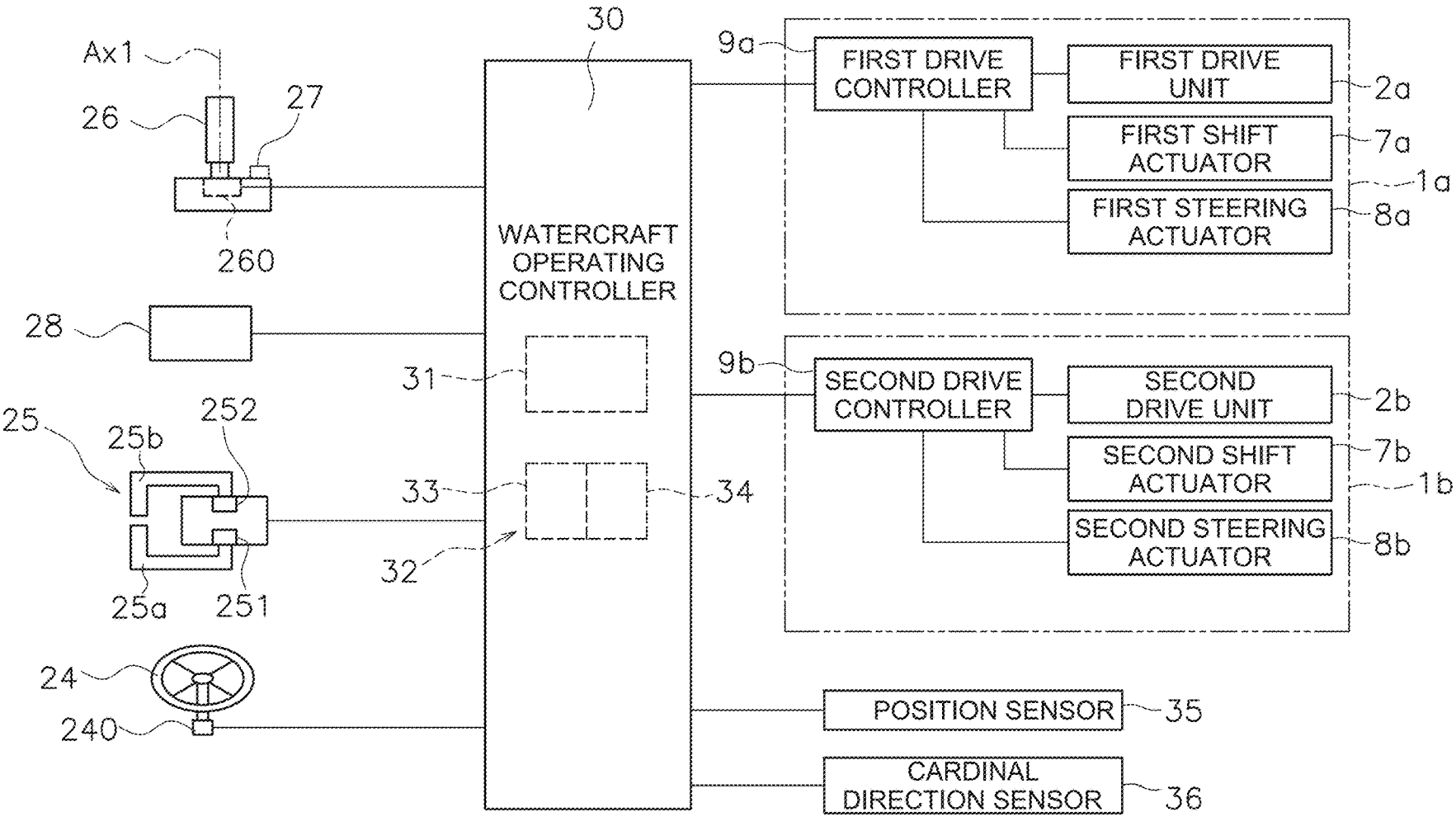
FIG. 3 is a schematic diagram showing a configuration of a watercraft operating system for the watercraft.

FIG. 3 is a schematic diagram showing a configuration of a watercraft operating system for the watercraft 100. As shown in FIG. 3, the first marine propulsion device 1*a* includes a first shift actuator 7*a* and a first steering actuator 8*a*. The first shift actuator 7*a* is connected to the dog clutch 16*a* of the first shift mechanism 5*a*. The first shift actuator 7*a* actuates the dog clutch 16*a* to switch gear engagement of each gear 14*a*, 15*a*. Movement of the watercraft 100 is thus switched between forward movement and rearward movement. The first shift actuator 7*a* is, for instance, an electric motor. However, the first shift actuator 7*a* may be another type of actuator such as an electric cylinder, a hydraulic motor, or a hydraulic cylinder.

The first steering actuator 8*a* is connected to the first marine propulsion device 1*a*. The first steering actuator 8*a* rotates the first marine propulsion device 1*a* about the first steering shaft 12*a*. Accordingly, the first marine propulsion device 1*a* is changed in rudder angle (first rudder angle θa). The first rudder angle θa refers to an angle of a steering direction of the first marine propulsion device 1*a* with respect to a back-and-forth direction of the watercraft 100. The steering direction of the first marine propulsion device 1*a* refers to the back-and-forth direction of the first marine propulsion device 1*a*, in other words, an extending direction of the propeller shaft 4*a*. The first steering actuator 8*a* is, for instance, an electric motor. However, the first steering actuator 8*a* may be another type of actuator such as an electric cylinder, a hydraulic motor, or a hydraulic cylinder.

The first marine propulsion device 1*a* includes a first drive controller 9*a*. The first drive controller 9*a* includes a processor such as a CPU (Central Processing Unit) and memories such as a RAM (Random Access Memory) and a ROM (Read Only Memory). The first drive controller 9*a* stores a program and data to control the first marine propulsion device 1*a*. The first drive controller 9*a* controls the first drive unit 2*a*.

Figure 4:
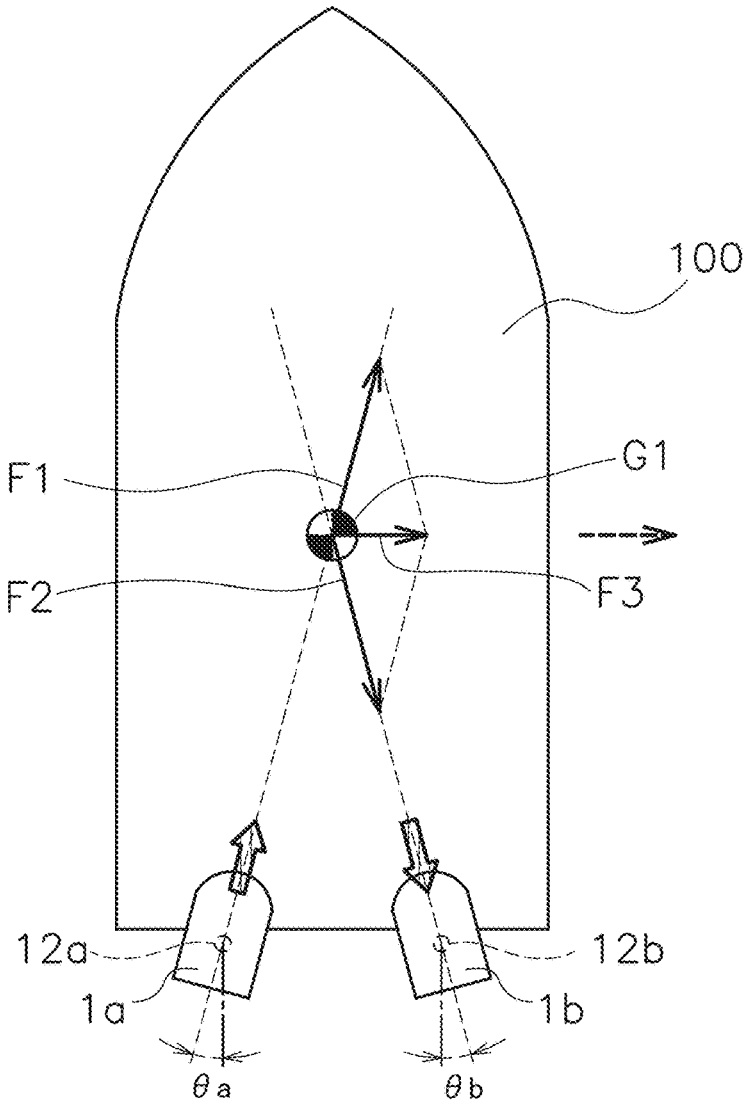
FIG. 4 is a schematic diagram showing controls of the marine propulsion devices executed when an operating device is tilted straight sideways.
Figure 4:
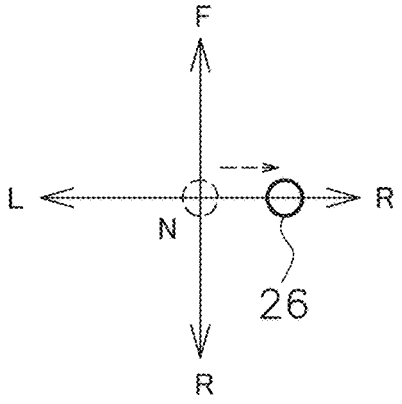

The second marine propulsion device 1*b* is configured in similar manner to the first marine propulsion device 1*a*. The second marine propulsion device 1*b* includes a second drive unit 2*b*, a second shift actuator 7*b*, a second steering actuator 8*b*, and a second drive controller 9*b*. The second drive unit 2*b*, the second shift actuator 7*b*, the second steering actuator 8*b*, and the second drive controller 9*b* in the second marine propulsion device 1*b* are configured in similar manner to the first drive unit 2*a*, the first shift actuator 7*a*, the first steering actuator 8*a*, and the first drive controller 9*a* in the first marine propulsion device 1*a*, respectively. FIG. 4 is a diagram schematically showing the watercraft 100 and the marine propulsion devices 1*a* and 1*b*. As shown in FIG. 4, the second marine propulsion device 1*b* is rotatable about a second steering shaft 12*b*.

The watercraft operating system includes a steering wheel 24, a remote controller 25, an operating device 26 (operator), a first input device 27, and a second input device 28. As shown in FIG. 1, the steering wheel 24, the remote controller 25, the operating device 26, the first input device 27, and the second input device 28 are disposed in a cockpit of the watercraft 100. The steering wheel 24, the remote controller 25, the operating device 26, the first input device 27, and the second input device 28 are manually operable.

The steering wheel 24 allows a user to operate a turning direction of the watercraft 100. The steering wheel 24 includes a sensor 240. The sensor 240 outputs a steering signal indicating an operating direction and an operating amount of the steering wheel 24.

The remote controller 25 includes a first throttle lever 25*a* and a second throttle lever 25*b*. The first throttle lever 25*a* allows the user to regulate the magnitude of the thrust (first thrust) generated by the first marine propulsion device 1*a*. The first throttle lever 25*a* also allows the user to switch the direction of the first thrust generated by the first marine propulsion device 1*a* between a forward moving direction and a rearward moving direction. The first throttle lever 25*a* is operable from a neutral position to a forward moving directional side and a rearward moving directional side. The neutral position is a position located between the forward moving directional side and the rearward moving directional side. The first throttle lever 25*a* includes a sensor 251. The sensor 251 outputs a throttle signal indicating an operating direction and an operating amount of the first throttle lever 25*a*.

The second throttle lever 25*b* allows the user to regulate the magnitude of the thrust (second thrust) generated by the second marine propulsion device 1*b*. The second throttle lever 25*b* also allows the user to switch the direction of the second thrust generated by the second marine propulsion device 1*b* between the forward moving direction and the rearward moving direction. The second throttle lever 25*b* is configured in similar manner to the first throttle lever 25*a*. The second throttle lever 25*b* includes a sensor 252. The sensor 252 outputs a throttle signal indicating an operating direction and an operating amount of the second throttle lever 25*b*.

The operating device 26 allows the user to operate the movement of the watercraft 100 in each of the moving directions of front, rear, right, and left. The operating device 26 also allows the user to operate a bow turning motion performed by the watercraft 100. The operating device 26 is, for instance, a joystick. The operating device 26 is tiltable from a neutral position in at least four directions of front, rear, right, and left. Four or more directions, and furthermore, all directions may be instructible by the operating device 26. The operating device 26 is rotatable (twistable) about a rotational axis Ax1. In other words, the operating device 26 is operable to be twisted clockwise and counterclockwise about the rotational axis Ax1 from the neutral position.

The operating device 26 includes a sensor 260. The sensor 260 outputs an operating signal that indicates operating the operating device 26. The operating signal contains information regarding a tilt direction and a tilt amount of the operating device 26. The operating signal also contains information regarding a twist direction and a twist amount of the operating device 26.

The watercraft operating system includes a watercraft operating controller 30. The watercraft operating controller 30 includes a processor 31 such as a CPU and a memory 32. The memory 32 includes a volatile memory 33 and a non-volatile memory 34. The volatile memory 33 is a RAM (Random Access Memory) such as a SRAM (Static RAM) or a DRAM (Dynamic RAM). The volatile memory 33 loses data stored therein when stopped being powered by a power source. The non-volatile memory 34 is, for instance, a ROM or a flash memory. The non-volatile memory 34 keeps data stored therein even without being powered by the power source.

The watercraft operating controller 30 stores programs and data to control the first and second marine propulsion devices 1*a* and 1*b*. The watercraft operating controller 30 is connected to the first and second drive controllers 9*a* and 9*b* through wired or wireless communication. The watercraft operating controller 30 is connected to the steering wheel 24, the remote controller 25, the operating device 26, the first input device 27, and the second input device 28 through wired or wireless communication.

The watercraft operating controller 30 receives the steering signal from the sensor 240. The watercraft operating controller 30 receives the throttle signal from each sensor 251, 252. The watercraft operating controller 30 receives the operating signal from the sensor 260. The watercraft operating controller 30 outputs command signals to the first and second drive controllers 9*a* and 9*b* based on the signals received from the sensors 240, 251, 252, and 260. The command signals are transmitted to the first shift actuator 7*a* and the first steering actuator 8*a* through the first drive controller 9*a*. The command signals are transmitted to the second shift actuator 7*b* and the second steering actuator 8*b* through the second drive controller 9*b*.

For example, the watercraft operating controller 30 outputs a command signal for the first shift actuator 7*a* in accordance with the operating direction of the first throttle lever 25*a*. In response, shifting between forward movement and rearward movement by the first marine propulsion device 1*a* is made. The watercraft operating controller 30 outputs a throttle command for the first drive unit 2*a* in accordance with the operating amount of the first throttle lever 25*a*. The first drive controller 9*a* controls an output rotational speed of the first marine propulsion device 1*a* in accordance with the throttle command.

The watercraft operating controller 30 outputs a command signal for the second shift actuator 7*b* in accordance with the operating direction of the second throttle lever 25*b*. In response, shifting between forward movement and rearward movement by the second marine propulsion device 1*b* is made. The watercraft operating controller 30 outputs a throttle command for the second drive unit 2*b* in accordance with the operating amount of the second throttle lever 25*b*. The second drive controller 9*b* controls an output rotational speed of the second marine propulsion device 1*b* in accordance with the throttle command.

The watercraft operating controller 30 outputs a command signal for each of the first and second steering actuators 8*a* and 8*b* in accordance with the operating direction and the operating amount of the steering wheel 24. When the steering wheel 24 is operated leftward from the neutral position, the watercraft operating controller 30 controls the first and second steering actuators 8*a* and 8*b* such that the first and second marine propulsion devices 1*a* and 1*b* are rotated rightward. The watercraft 100 thus turns leftward.

When the steering wheel 24 is operated rightward from the neutral position, the watercraft operating controller 30 controls the first and second steering actuators 8*a* and 8*b* such that the first and second marine propulsion devices 1*a* and 1*b* are rotated leftward. The watercraft 100 thus turns rightward. Additionally, the watercraft operating controller 30 controls the rudder angle θa of the first marine propulsion device 1*a* and the rudder angle θb of the second marine propulsion device 1*b* in accordance with the operating amount of the steering wheel 24. It should be noted that a controller different from the watercraft operating controller 30 may control the rudder angles θa and θb of the first and second marine propulsion devices 1*a* and 1*b* in accordance with the operating amount of the steering wheel 24. Alternatively, the first and second drive units 2*a* and 2*b* may directly control the rudder angles θa and θb of the first and second marine propulsion devices 1*a* and 1*b* in accordance with the operating amount of the steering wheel 24.

The watercraft operating system includes a position sensor 35. The position sensor 35 detects a position of the watercraft 100. The position sensor 35 is, for example, a GNSS (Global Navigation Satellite System) receiver such as a GPS (Global Positioning System) receiver. However, the position sensor 35 may be a type of sensor other than the GNSS receiver. The position sensor 35 outputs a signal indicating the position of the watercraft 100. The watercraft operating controller 30 is connected to the position sensor 35 in a communicable manner. The watercraft operating controller 30 obtains the position of the watercraft 100 based on the signal received from the position sensor 35. Additionally, the watercraft operating controller 30 obtains a velocity of the watercraft 100 based on the signal received from the position sensor 35. The watercraft operating system may include another type of sensor to detect the velocity of the watercraft 100.

The watercraft operating system includes a cardinal direction sensor 36. The cardinal direction sensor 36 detects a course of the watercraft 100. The cardinal direction sensor 36 is, for instance, an IMU (Inertial Measurement Unit). However, the cardinal direction sensor 36 may be a type of sensor other than the IMU. The watercraft operating controller 30 is connected to the cardinal direction sensor 36 in a communicable manner. The watercraft operating controller 30 obtains the course of the watercraft 100 based on a signal received from the cardinal direction sensor 36.

The first input device 27 is operable by the user to select one of control modes of each marine propulsion device 1*a*, 1*b*. The first input device 27 may be disposed on the operating device 26. Alternatively, the first input device 27 may be disposed in a position separated from the operating device 26. The first input device 27 is, for instance, at least one switch. The first input device 27 may be another type of device such as a touchscreen without being limited to the at least one switch. The first input device 27 outputs a command signal indicating the control mode selected by the user. The watercraft operating controller 30 receives the command signal from the first input device 27. The watercraft operating controller 30 controls the marine propulsion devices 1*a* and 1*b* such that the watercraft 100 moves in accordance with the selected control mode. The control modes include modes executed by operating the operating device 26 (hereinafter simply referred to as "operating modes"). The watercraft operating controller 30 determines whether the operating modes are enabled or disabled in response to operating the first input device 27.

The second input device 28 is operable by the user to perform a control mode setting. The second input device 28 may be disposed in a position separated from the operating device 26. Alternatively, the second input device 28 may be disposed on the operating device 26. The second input device 28 is, for instance, a touchscreen. The second input device 28 is not limited to the touchscreen, and alternatively, may be another type of device such as at least one switch. The second input device 28 outputs a command signal indicating the setting of the control mode selected by the user. The watercraft operating controller 30 receives the command signal from the second input device 28.

When the operating modes are enabled, the watercraft operating controller 30 controls the first and second marine propulsion devices 1*a* and 1*b* such that the watercraft 100 performs a desired motion in response to operating the operating device 26. The watercraft operating controller 30 determines a first F/R direction, a first target thrust, and a first target rudder angle for the first marine propulsion device 1*a* and a second F/R direction, a second target thrust, and a second target rudder angle for the second marine propulsion device 1*b* such that the watercraft 100 performs a translational motion at a velocity depending on the tilt amount of the operating device 26 in a direction corresponding to the tilt direction of the operating device 26. The watercraft operating controller 30 determines the first F/R direction, the first target thrust, and the first target rudder angle for the first marine propulsion device 1*a* and the second F/R direction, the second target thrust, and the second target rudder angle for the second marine propulsion device 1*b* such that the watercraft 100 performs the bow turning motion at a velocity depending on the twist amount of the operating device 26 in a direction corresponding to the twist direction of the operating device 26.

The first F/R direction refers to a direction of the first thrust generated forward or rearward by the first marine propulsion device 1*a*. The first target thrust refers to a target magnitude of the first thrust generated by the first marine propulsion device 1*a*. The first target rudder angle refers to a target value of the first rudder angle θa of the first marine propulsion device 1*a*. The second F/R direction refers to a direction of the second thrust generated forward or rearward by the second marine propulsion device 1*b*. The second target thrust refers to a target magnitude of the second thrust generated by the second marine propulsion device 1*b*. The second target rudder angle refers to a target value of the rudder angle (second rudder angle θb) of the second marine propulsion device 1*b*.

The watercraft operating controller 30 controls the first drive unit 2*a*, the first shift actuator 7*a*, and the first steering actuator 8*a* in accordance with the first F/R direction, the first target thrust, and the first target rudder angle for the first marine propulsion device 1*a*. The watercraft operating controller 30 controls the second drive unit 2*b*, the second shift actuator 7*b*, and the second steering actuator 8*b* in accordance with the second F/R direction, the second target thrust, and the second target rudder angle for the second marine propulsion device 1*b*.

The operating modes will be explained in detail. When the operating device 26 is tilted straight sideways without being twisted, the watercraft operating controller 30 causes the watercraft 100 to perform the translational motion in a straight sideways direction (swaying mode). For example, when the operating device 26 is tilted straight rightward without being twisted, as shown in FIG. 4, the watercraft operating controller 30 determines a forward moving direction as the first F/R direction of the first marine propulsion device 1*a*, while determining a rearward moving direction as the second F/R direction of the second marine propulsion device 1*b*. Additionally, the watercraft operating controller 30 determines the first target thrust, the first target rudder angle, the second target thrust, and the second target rudder angle such that a net thrust (F3) of the first thrust (F1) and the second thrust (F2) extends from the center of gravity (G1) of the watercraft 100 and faces straight rightward. The watercraft 100 thus performs the translational motion in a straight rightward direction.

Although not shown in the drawings, when the operating device 26 is tilted straight leftward without being twisted, the watercraft operating controller 30 determines the rearward moving direction as the first F/R direction of the first marine propulsion device 1*a*, while determining the forward moving direction as the second F/R direction of the second marine propulsion device 1*b*. Additionally, the watercraft operating controller 30 determines the first target thrust, the first target rudder angle, the second target thrust, and the second target rudder angle such that the net thrust F3 extends from the center-of-gravity G1 of the watercraft 100 and faces straight leftward. The watercraft 100 thus performs the translational motion in a straight leftward direction.

It should be noted that in FIG. 4, "N" indicates the neutral position of the operating device 26. "F" indicates that the operating device 26 is operated in the forward moving direction. "R" indicates that the operating device 26 is operated in the rearward moving direction. "L" indicates that the operating device 26 is operated in the left direction. "R" indicates that the operating device 26 is operated in the right direction.

Figure 5:
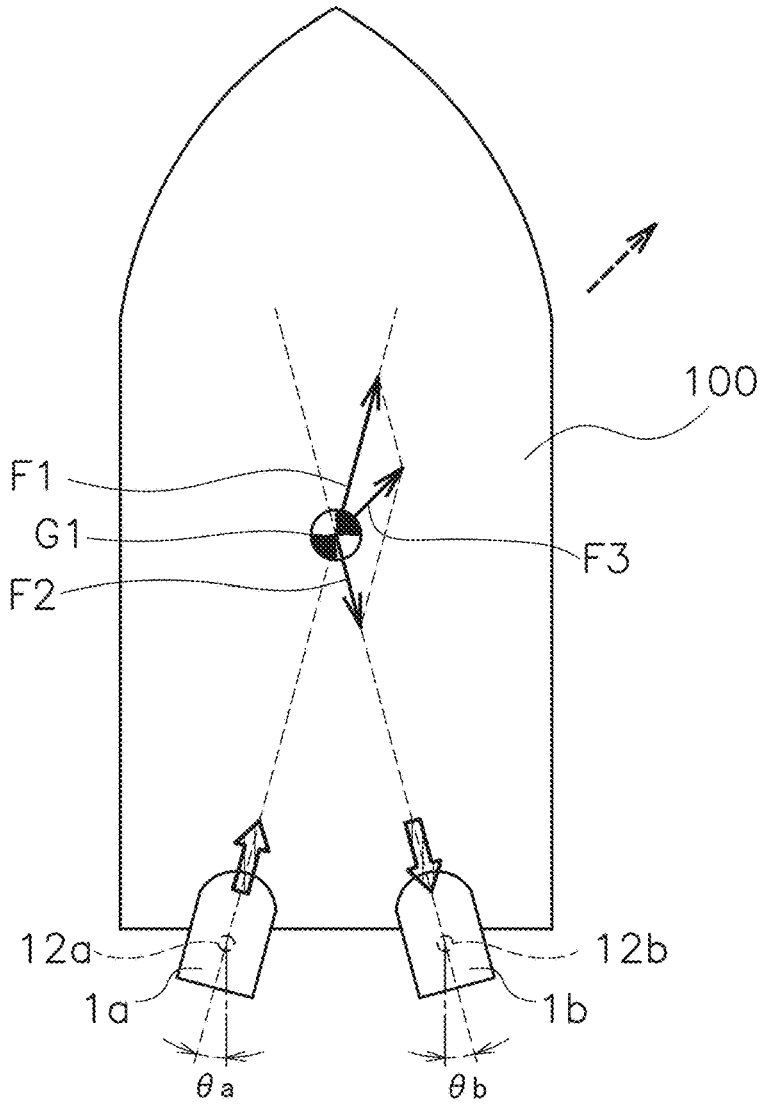
FIG. 5 is a schematic diagram showing controls of the marine propulsion devices executed when the operating device is tilted obliquely.
Figure 5:
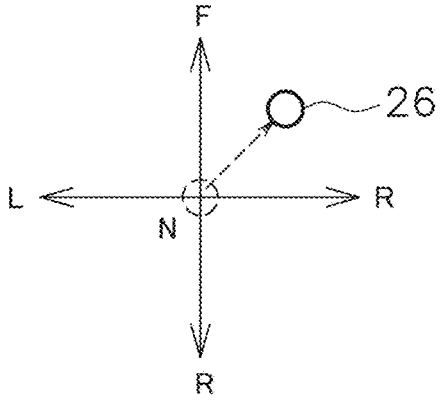

When the operating device 26 is tilted obliquely without being twisted, the watercraft operating controller 30 moves the watercraft 100 obliquely. For example, as shown in FIG. 5, when the operating device 26 is tilted in a right front direction without being twisted, the watercraft operating controller 30 determines the forward moving direction as the first F/R direction of the first marine propulsion device 1*a*, while determining the rearward moving direction as the second F/R direction of the second marine propulsion device 1*b*. Additionally, the watercraft operating controller 30 determines the first target thrust, the first target rudder angle, the second target thrust, and the second target rudder angle such that the net thrust F3 extends from the center-of-gravity G1 of the watercraft 100 and faces the right front direction. The watercraft 100 thus performs the translational motion in the right front direction.

Although not shown in the drawings, when the operating device 26 is tilted in a left front direction without being twisted, the watercraft operating controller 30 determines the rearward moving direction as the first F/R direction of the first marine propulsion device 1*a*, while determining the forward moving direction as the second F/R direction of the second marine propulsion device 1*b*. Additionally, the watercraft operating controller 30 determines the first target thrust, the first target rudder angle, the second target thrust, and the second target rudder angle such that the net thrust F3 extends from the center-of-gravity G1 of the watercraft 100 and faces the left front direction. The watercraft 100 thus performs the translational motion in the left front direction. When the operating device 26 is tilted in either a right rear direction or a left rear direction without being twisted, the watercraft operating controller 30 determines the first target thrust and the second target thrust such that one of the first and second thrusts, oriented in the rearward moving direction, has a greater magnitude than the other oriented in the forward moving direction.

It should be noted that the watercraft operating controller 30 determines the first target thrust and the second target thrust based on a target thrust ratio. The target thrust ratio refers to a ratio of magnitude between the first thrust generated by the first marine propulsion device 1*a* and the second thrust generated by the second marine propulsion device 1*b*. Chances are that even when the first and second marine propulsion devices 1*a* and 1*b* are of the same model, there is a difference in output therebetween due to factors such as individual differences. The target thrust ratio is used to keep a balance in output between the first and second marine propulsion devices 1*a* and 1*b*. The target thrust ratio will be explained below in detail. The watercraft operating controller 30 determines a target net thrust depending on the tilt amount of the operating device 26. The target net thrust refers to a target value of the net thrust F3. The watercraft operating controller 30 determines the first target thrust and the second target thrust by decomposing the target net thrust based on the target thrust ratio.

Figure 6:
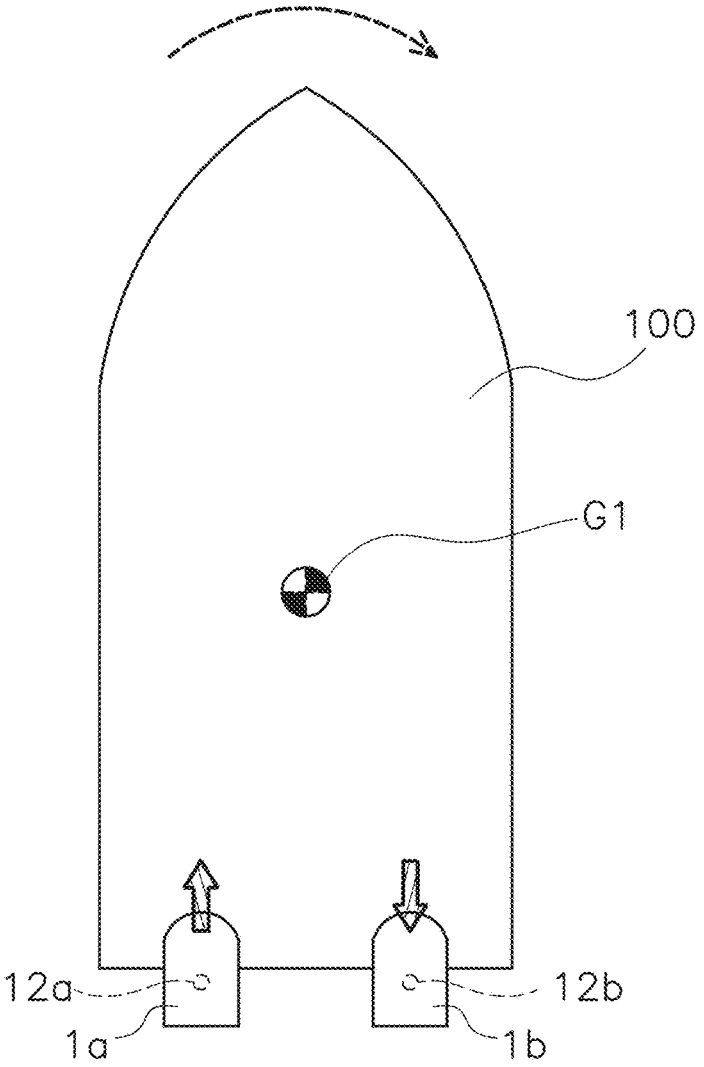
FIG. 6 is a schematic diagram showing controls of the marine propulsion devices executed when the operating device is twisted.
Figure 6:
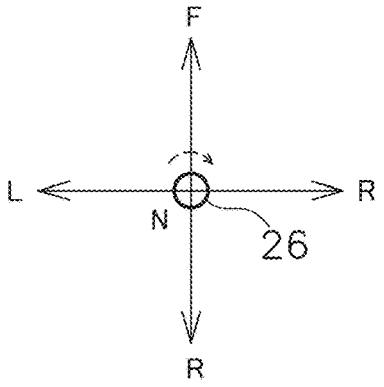

When the operating device 26 is twisted without being tilted, the watercraft operating controller 30 causes the watercraft 100 to perform the bow turning motion on the spot (on-the-spot bow turning mode). For example, as shown in FIG. 6, when the operating device 26 is twisted clockwise without being tilted, the watercraft operating controller 30 determines the forward moving direction as the first F/R direction of the first marine propulsion device 1*a*, while determining the rearward moving direction as the second F/R direction of the second marine propulsion device 1*b*. Additionally, the watercraft operating controller 30 determines the first target rudder angle and the second target rudder angle such that the steering direction of the first marine propulsion device 1*a* and that of the second marine propulsion device 1*b* are oriented parallel or substantially parallel to the back-and-forth direction of the watercraft 100. The watercraft 100 thus performs the bow turning motion clockwise on the spot.

Although not shown in the drawings, when the operating device 26 is twisted counterclockwise without being tilted, the watercraft operating controller 30 determines the rearward moving direction as the first F/R direction of the first marine propulsion device 1*a*, while determining the forward moving direction as the second F/R direction of the second marine propulsion device 1*b*. Additionally, the watercraft operating controller 30 determines the first target rudder angle and the second target rudder angle such that the steering direction of the first marine propulsion device 1*a* and that of the second marine propulsion device 1*b* are oriented parallel or substantially parallel to the back-and-forth direction of the watercraft 100. The watercraft 100 thus performs the bow turning motion counterclockwise on the spot.

Figure 7:
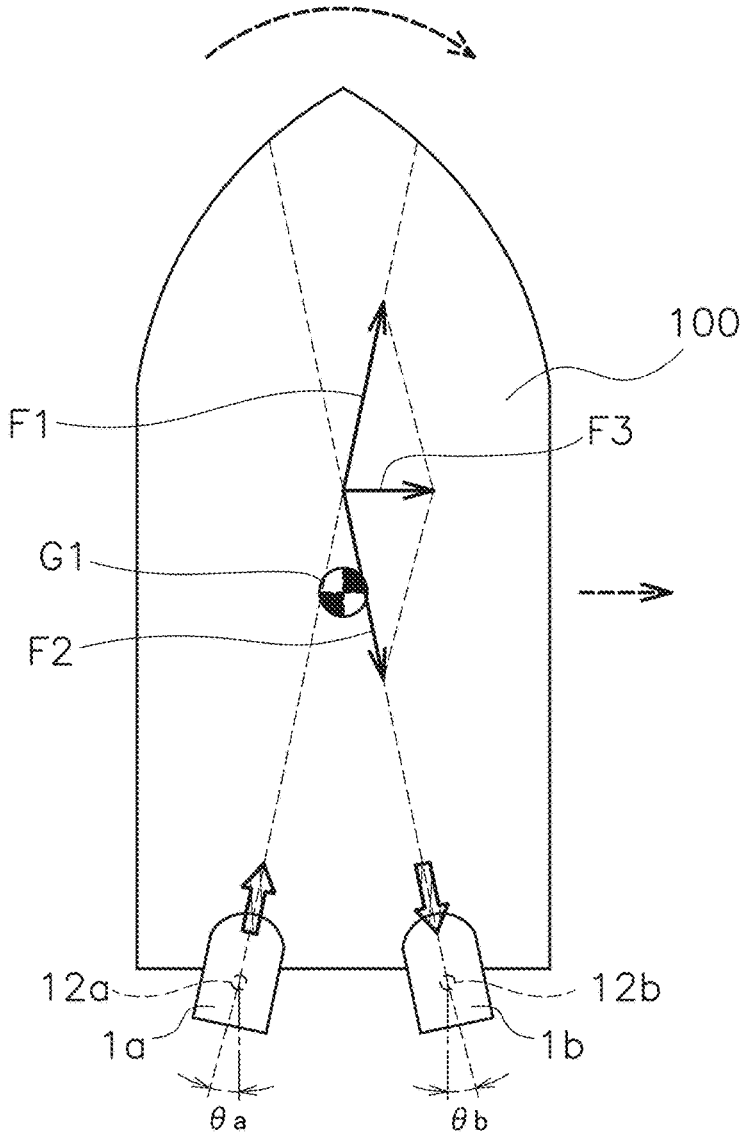
FIG. 7 is a schematic diagram showing controls of the marine propulsion devices executed when the operating device is twisted and tilted straight sideways.
Figure 7:
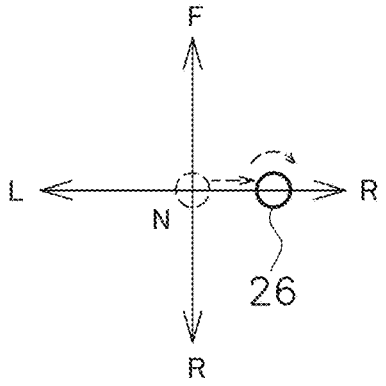

When the operating device 26 is tilted straight sideways while being twisted, the watercraft operating controller 30 causes the watercraft 100 to move straight sideways, and simultaneously, perform the bow turning motion. For example, as shown in FIG. 7, when the operating device 26 is tilted straight rightward, while being twisted clockwise, the watercraft operating controller 30 determines the forward moving direction as the first F/R direction of the first marine propulsion device 1*a*, while determining the rearward moving direction as the second F/R direction of the second marine propulsion device 1*b*. Additionally, the watercraft operating controller 30 determines the first target thrust, the first target rudder angle, the second target thrust, and the second target rudder angle such that the net thrust F3 extends from a predetermined position located ahead of the center-of-gravity G1 of the watercraft 100 and faces straight rightward. The watercraft 100 thus moves straight rightward, while performing the bow turning motion clockwise.

Although not shown in the drawings, when the operating device 26 is tilted straight rightward, while being twisted counterclockwise, the watercraft operating controller 30 determines the forward moving direction as the first F/R direction of the first marine propulsion device 1*a*, while determining the rearward moving direction as the second F/R direction of the second marine propulsion device 1*b*. Additionally, the watercraft operating controller 30 determines the first target thrust, the first target rudder angle, the second target thrust, and the second target rudder angle such that the net thrust F3 extends from a predetermined position located behind the center-of-gravity G1 of the watercraft 100 and faces straight rightward. The watercraft 100 thus moves straight rightward, while performing the bow turning motion counterclockwise.

The non-volatile memory 34 of the watercraft operating controller 30 stores a first default angle, a second default angle, and a default thrust ratio, all of which are used in the swaying mode. The first default angle is a default value for the first target rudder angle in the swaying mode. The second default angle is a default value for the second target rudder angle in the swaying mode. The default thrust ratio is a default value for the target thrust ratio in the swaying mode.

When the operating modes are activated, the watercraft operating controller 30 retrieves the first default angle, the second default angle, and the default thrust ratio from the non-volatile memory 34. Then, the watercraft operating controller 30 determines the first default angle, the second default angle, and the default thrust ratio as the first target rudder angle, the second target rudder angle, and the target thrust ratio, respectively. Therefore, in starting the swaying mode, the watercraft operating controller 30 controls the first and second marine propulsion devices 1*a* and 1*b* with the first default angle, the second default angle, and the default thrust ratio. The first default angle, the second default angle, and the default thrust ratio are stored in the non-volatile memory 34, while being preliminarily calibrated such that the watercraft 100 performs the translational motion in a straight sideways direction in response to operating the operating device 26 in the swaying mode.

Figure 8A:
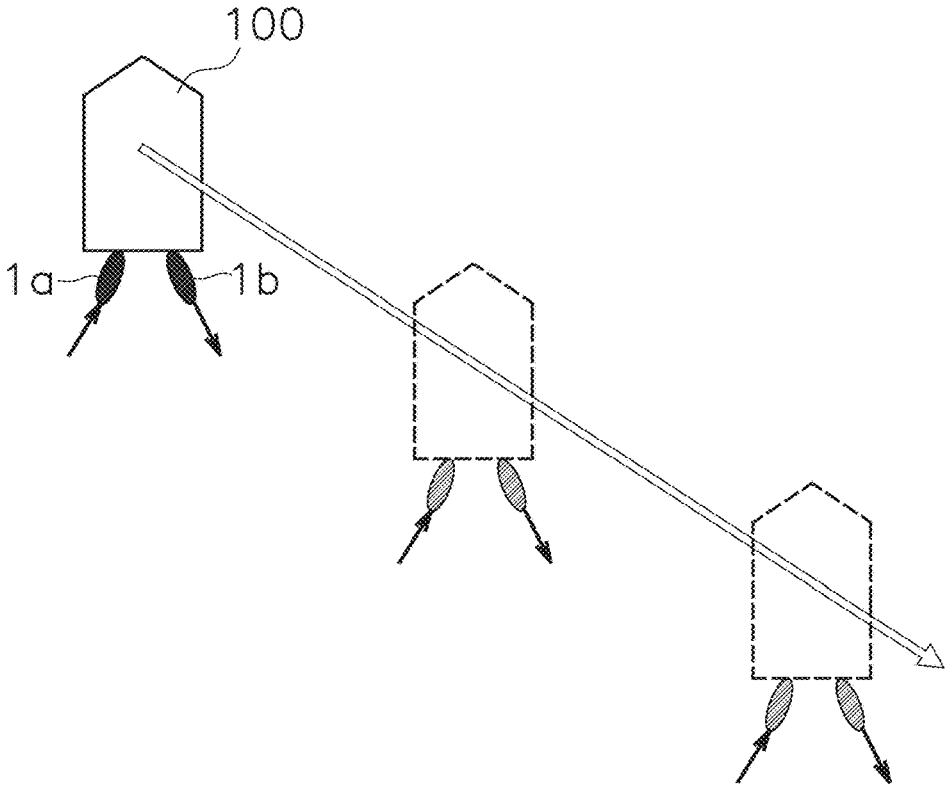
FIG. 8A is a diagram showing a series of motions performed by the watercraft without sideways assist control.
Figure 9A:
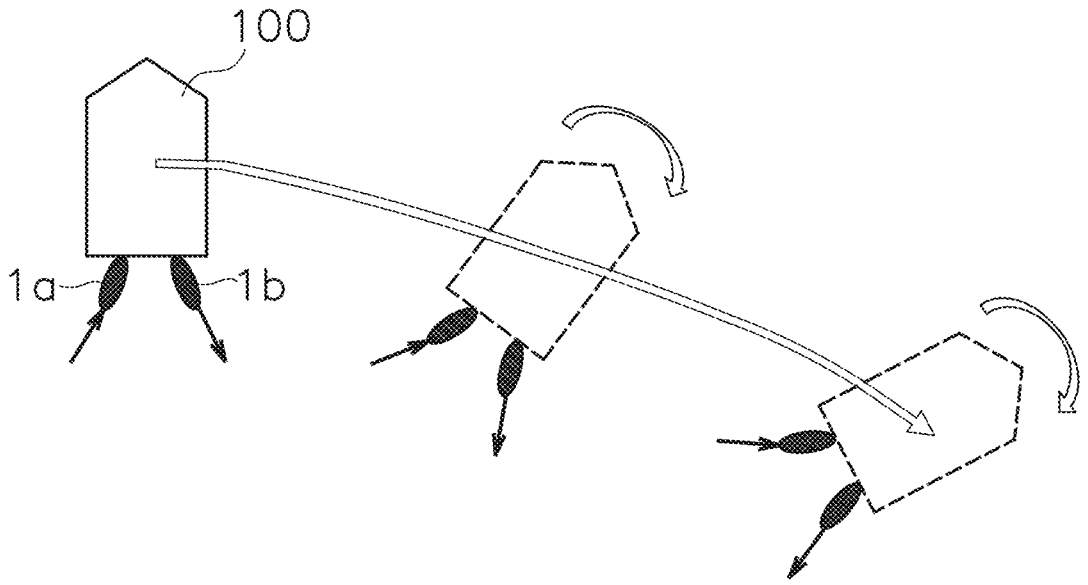
FIG. 9A is a diagram showing a series of motions performed by the watercraft without the sideways assist control.

In spite of the configuration described above, chances are that even when the operating device 26 is tilted straight sideways, the watercraft 100 obliquely moves due to external forces (tide, wind, etc.) as shown in FIG. 8A. Also, chances are that even when the operating device 26 is tilted straight sideways without being twisted, the watercraft 100 performs the bow turning motion due to external forces (tide, wind, etc.) as shown in FIG. 9A. To cope with these situations, in the watercraft operating system according to the present preferred embodiment, the watercraft operating controller 30 executes sideways assist control in the swaying mode. When executing the sideways assist control, the watercraft operating controller 30 corrects the first target rudder angle, the second target rudder angle, and the target thrust ratio such that the watercraft 100 moves straight sideways without performing the bow turning motion. A series of processes executed in the sideways assist control will be hereinafter explained.

Figure 10:
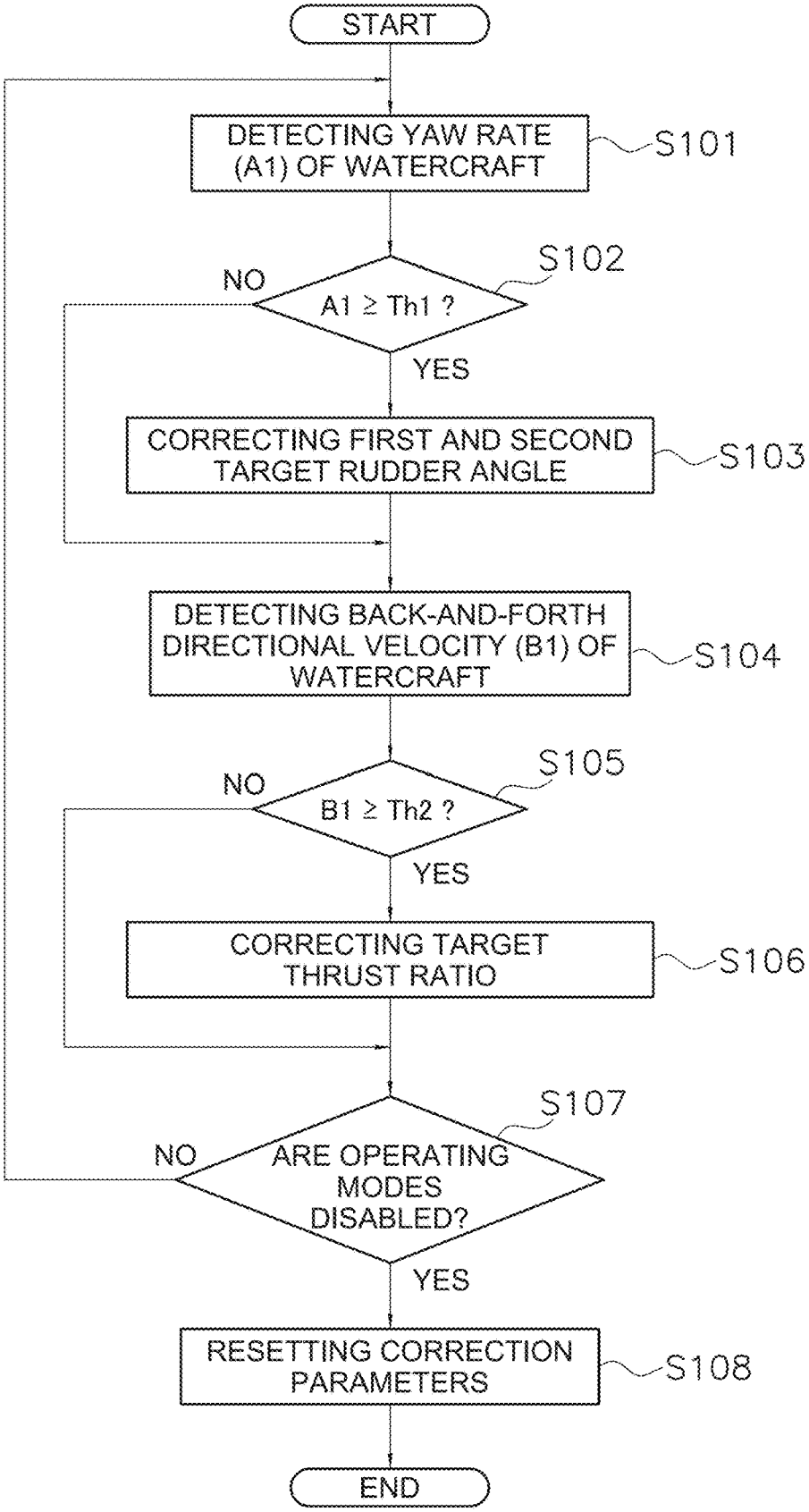
FIG. 10 is a flowchart showing a series of processes of the sideways assist control.

FIG. 10 is a flowchart showing the series of processes executed in the sideways assist control. It should be noted that the sideways assist control is executed when the operating modes are enabled. Additionally, with the second input device 28, it may be possible to set whether the sideways assist control is enabled or disabled. In this case, the series of processes shown in FIG. 10 may be executed as the sideways assist control when the operating modes are enabled, and simultaneously, the sideways assist control is enabled.

As shown in FIG. 10, in step S101, the watercraft operating controller 30 detects a yaw rate A1 of the watercraft 100. The watercraft operating controller 30 detects the yaw rate A1 of the watercraft 100 based on the signal received from the cardinal direction sensor 36. In step S102, it is determined whether or not the yaw rate A1 of the watercraft 100 is greater than or equal to a threshold Th1. For example, the threshold Th1 is set as a magnitude of yaw rate enough to determine that the actual motion of the watercraft 100 includes the bow turning motion. When the yaw rate A1 of the watercraft 100 is greater than or equal to the threshold Th1, the process proceeds to step S103.

Figure 9B:
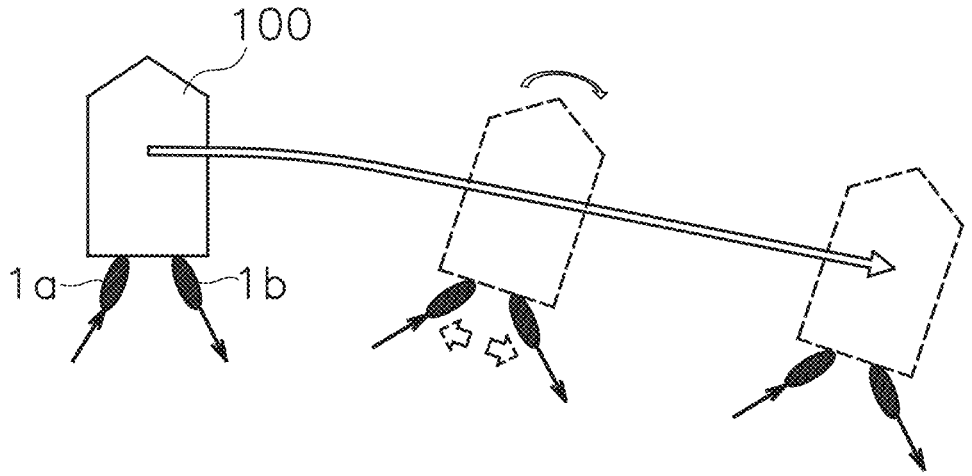
FIG. 9B is a diagram showing a series of motions performed by the watercraft with the sideways assist control.

In step S103, the watercraft operating controller 30 corrects the first target rudder angle and the second target rudder angle. The watercraft operating controller 30 determines a first correcting angle and a second correcting angle to reduce the bow turning motion of the watercraft 100. In other words, the watercraft operating controller 30 determines the first correcting angle and the second correcting angle such that the yaw rate A1 approaches 0. For example, when the watercraft 100 performs the bow turning motion clockwise as shown in FIG. 9A, the watercraft operating controller 30 determines the first correcting angle and the second correcting angle to increase an angle formed between the steering direction of the first marine propulsion device 1*a* and that of the second marine propulsion device 1*b* as shown in FIG. 9B.

The watercraft operating controller 30 corrects the first target rudder angle with the first correcting angle, while correcting the second target rudder angle with the second correcting angle. For example, the watercraft operating controller 30 corrects the first target rudder angle by adding the first correcting angle to the first default angle. Likewise, the watercraft operating controller 30 corrects the second target rudder angle by adding the second correcting angle to the second default angle. Alternatively, the watercraft operating controller 30 may correct the first target rudder angle by multiplying the first default angle with the first correcting angle. Likewise, the watercraft operating controller 30 may correct the second target rudder angle by multiplying the second default angle with the second correcting angle.

The watercraft operating controller 30 saves the first correcting angle and the second correcting angle in the volatile memory 33. The watercraft operating controller 30 controls the first marine propulsion device 1*a* with the corrected first target rudder angle, while controlling the second marine propulsion device 1*b* with the corrected second target rudder angle. Accordingly, the net thrust of the first thrust and the second thrust approaches to the center-of-gravity G1 of the watercraft 100. As a result, the watercraft 100 is inhibited from performing the bow turning motion as shown in FIG. 9B.

In step S104, the watercraft operating controller 30 detects a back-and-forth directional velocity B1 of the watercraft 100. The watercraft operating controller 30 detects the back-and-forth directional velocity B1 of the watercraft 100 based on the signal received from the position sensor 35. In step S105, the watercraft operating controller 30 determines whether or not the back-and-forth directional velocity B1 of the watercraft 100 is greater than or equal to a threshold Th2. The threshold Th2 is set as a magnitude of velocity enough to determine that the actual motion of the watercraft 100 includes the back-and-forth movement. When the back-and-forth directional velocity B1 of the watercraft 100 is greater than or equal to the threshold Th2, the process proceeds to step S106.

In step S106, the watercraft operating controller 30 corrects the target thrust ratio. The watercraft operating controller 30 determines a correcting thrust ratio such that back-and-forth movement of the watercraft 100 is reduced. In other words, the watercraft operating controller 30 determines the correcting thrust ratio such that a back-and-forth directional velocity B1 of the watercraft 100 approaches 0. When the watercraft 100 moves obliquely rearward, the watercraft operating controller 30 determines the correcting thrust ratio such that the thrust oriented in the forward moving direction is increased in magnitude. For example, as shown in FIG. 8A, when the watercraft 100 moves in a right rear direction, the watercraft operating controller 30 determines the correcting thrust ratio such that the first thrust generated by the first marine propulsion device 1*a* is greater in magnitude than the second thrust generated by the second marine propulsion device 1*b*.

The watercraft operating controller 30 corrects the target thrust ratio with the correcting thrust ratio. For example, the watercraft operating controller 30 corrects the target thrust ratio by adding the correcting thrust ratio to the default thrust ratio. Alternatively, the watercraft operating controller 30 may correct the target thrust ratio by multiplying the default thrust ratio with the correcting thrust ratio.

Figure 8B:
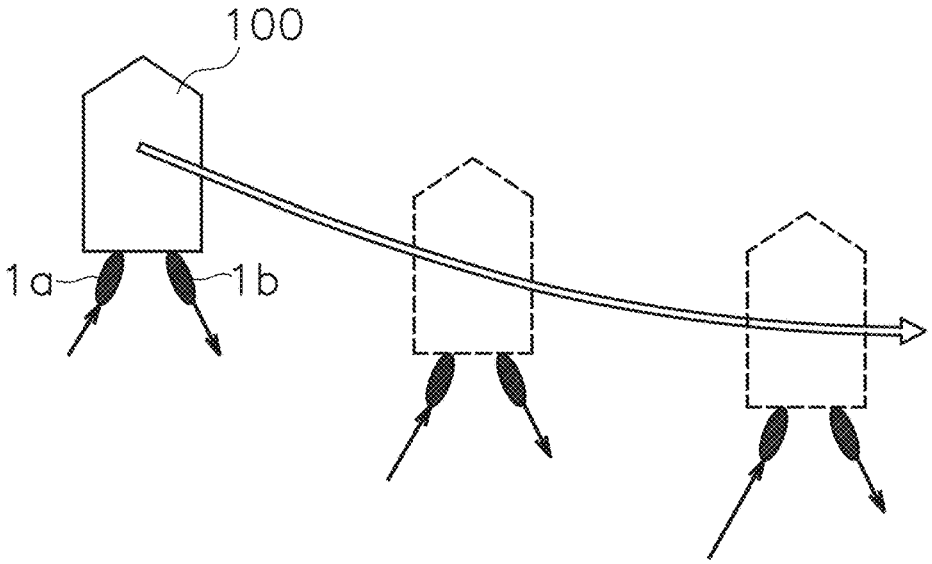
FIG. 8B is a diagram showing a series of motions performed by the watercraft with the sideways assist control.

The watercraft operating controller 30 saves the correcting thrust ratio in the volatile memory 33. The watercraft operating controller 30 determines the first target thrust and the second target thrust based on the corrected target thrust ratio. Accordingly, the net thrust F3 of the first thrust F1 and the second thrust F2 is oriented in a direction close to a straight sideways direction. As a result, as shown in FIG. 8B, the watercraft 100 is inhibited from moving obliquely rearward.

In step S107, the watercraft operating controller 30 determines whether or not the operating modes are disabled. The watercraft operating controller 30 determines whether or not the operating modes are disabled based on the signal received form the first input device 27. When the operating modes are not disabled, in other words, when the operating modes are enabled, the watercraft operating controller 30 repeatedly executes the process steps S101 to S106 described above. In other words, the watercraft operating controller 30 repeatedly updates the first correcting angle and the second correcting angle, while repeatedly detecting the yaw rate A1 of the watercraft 100. Additionally, the watercraft operating controller 30 repeatedly updates the correcting thrust ratio, while repeatedly detecting the back-and-forth directional velocity B1 of the watercraft 100.

Conversely, when the operating modes are disabled, the process proceeds to step S108. In step S108, the watercraft operating controller 30 resets correction parameters. The correction parameters refer to the first correcting angle, the second correcting angle, and the correcting thrust ratio, all of which are described above. In other words, when the operating modes are disabled, the watercraft operating controller 30 resets all the first correcting angle, the second correcting angle, and the correcting thrust ratio to 0 and ends the operating modes. However, even when the operating modes are disabled, the watercraft operating controller 30 keeps the first default angle, the second default angle, and the default thrust ratio, all of which are stored in the non-volatile memory 34.

In the system for operating the watercraft 100 according to the present preferred embodiment explained above, the yaw rate A1 and the back-and-forth directional velocity of the watercraft 100 in the swaying mode are detected as an error between the actual motion and the straight sideways movement of the watercraft 100. Additionally, the first correcting angle, the second correcting angle, and the correcting thrust ratio are determined to reduce the error. Furthermore, the error is repeatedly detected, and the first correcting angle, the second correcting angle, and the correcting thrust ratio are repeatedly updated in accordance with the error. In other words, even when external forces attributed to external factors change, the first correcting angle, the second correcting angle, and the correcting thrust ratio are determined and updated on a real time basis in accordance with change in external forces. Because of this, the watercraft 100 is able to be stably moved sideways.

On the other hand, when the operating modes are disabled, the first correcting angle, the second correcting angle, and the correcting thrust ratio are reset. Therefore, when the operating modes are enabled next time, the first default angle, the second default angle, and the default thrust ratio are determined as the first target rudder angle, the second target rudder angle, the first target thrust, and the second target thrust in the initial stage of starting the operating modes. Because of this, when the operating modes are used anew in an environment different from that in previous use of the operating modes, the first correcting angle, the second correcting angle, and the correcting thrust ratio are determined to be suitable for the new environment without using those determined in the previous environment. Accordingly, the watercraft 100 is quickly and accurately moved straight sideways.

Preferred embodiments of the present invention have been explained above. However, the present invention is not limited to the preferred embodiments described above, and a variety of changes can be made without departing from the gist of the present invention.

Each marine propulsion device is not limited to the outboard motor, and alternatively, may be another type of propulsion device such as an inboard engine outboard drive or a jet propulsion device. The structure of each marine propulsion device is not limited to that in the preferred embodiments described above and may be changed. For example, the first drive unit 2*a* is not limited to the internal combustion engine, and alternatively, may be an electric motor. Yet alternatively, the first drive unit 2*a* may be a hybrid system of an internal combustion engine and an electric motor. The number of marine propulsion devices is not limited to two. The number of marine propulsion devices may be more than two. For example, when the number of marine propulsion devices is three, middle one of the three marine propulsion devices may be controlled in similar manner to either of right and left ones of the three marine propulsion devices. In this case, similar control to the above may be executed with the sum of thrusts generated by two marine propulsion devices that the output directions thereof are set to be identical. The operating device 26 is not limited to the joystick, and alternatively, may be another type of operating device such as a touchscreen.

The series of processes executed in the sideways assist control are not limited to those in the preferred embodiments described above and may be changed. For example, the order of executing the process steps is not limited to that in the preferred embodiments described above and may be changed. The series of processes in the preferred embodiments described above may be omitted in part. A single or plurality of process steps, different from the process steps executed in the preferred embodiments described above, may be additionally executed.

Not the target thrust ratio but alternatively the first target thrust and the second target thrust may be corrected. In the swaying mode, the watercraft operating controller 30 may determine a first correcting thrust and a second correcting thrust such that the back-and-forth directional velocity B1 of the watercraft 100 is reduced. The watercraft operating controller 30 may correct the first target thrust with the first correcting thrust. The watercraft operating controller 30 may correct the second target thrust with the second correcting thrust. The first correcting thrust and the second correcting thrust may be entered and saved in the volatile memory 33. In similar manner to the correcting thrust ratio, the first correcting thrust and the second correcting thrust may be reset when the operating modes are disabled.

The sideways assist control may be applied not only to straight sideways movement of the watercraft 100 but also to oblique movement of the watercraft 100. For example, when the operating device 26 is obliquely tilted without being twisted, the watercraft operating controller 30 may determine whether or not the back-and-forth directional velocity of the watercraft 100 is greater than or equal to a threshold Th3. The threshold Th3 may be a magnitude of velocity depending on the tilt amount of the operating device 26 operated in the back-and-forth direction. When the back-and-forth directional velocity of the watercraft 100 is less than the threshold Th3, the watercraft operating controller 30 may correct the target thrust ratio. The watercraft operating controller 30 may determine the correcting thrust ratio such that the back-and-forth directional velocity of the watercraft 100 approaches the threshold Th3.

The sideways assist control may be applied to the condition that the operating device 26 is tilted straight sideways, while being twisted. For example, when the operating device 26 is tilted straight sideways, while being twisted, the watercraft operating controller 30 may determine whether or not the yaw rate A1, i.e., the actual yaw rate of the watercraft 100, is greater than or equal to a threshold Th4. When the yaw rate A1 of the watercraft 100 is less than the threshold Th4, the watercraft operating controller 30 may correct the first target rudder angle and the second target rudder angle. The watercraft operating controller 30 may correct the first target rudder angle and the second target rudder angle such that the actual yaw rate A1 of the watercraft 100 approaches the threshold Th4.

The first correcting angle, the second correcting angle, and the correcting thrust ratio, all of which are obtained in the sideways assist control, may be utilized in one or more operating modes other than the swaying mode. For example, in the on-the-spot bow turning mode, the watercraft operating controller 30 may determine the first target thrust and the second target thrust with the target thrust ratio corrected with the correcting thrust ratio.

In the sideways assist control, correction may be executed only for the first target rudder angle and the second target rudder angle with the first correcting angle and the second correcting angle. Alternatively, in the sideways assist control, correction may be executed only for the target thrust ratio with the correcting thrust ratio.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A system for controlling a watercraft, the system comprising:

a first marine propulsion device rotatable about a first steering shaft;

a second marine propulsion device rotatable about a second steering shaft;

an operator manually operable to output an operating signal indicating a desired motion of the watercraft; and a controller configured or programmed to:

determine a first target rudder angle of the first marine propulsion device, a second target rudder angle of the second marine propulsion device, and a target thrust ratio in accordance with the operating signal, the target thrust ratio being a ratio of magnitude between a first thrust generated by the first marine propulsion device and a second thrust generated by the second marine propulsion device;

control the first marine propulsion device and the second marine propulsion device based on the first target rudder angle, the second target rudder angle, and the target thrust ratio such that the watercraft performs the desired motion;

store a first default angle for the first target rudder angle, a second default angle for the second target rudder angle, and a default thrust ratio for the target thrust ratio, the first default angle, the second default angle, and the default thrust ratio being preliminarily set such that a net thrust of the first thrust and the second thrust is oriented straight sideways and extends from a center of gravity of the watercraft;

when the desired motion is straight sideways movement, control the first marine propulsion device and the second marine propulsion device to start moving the watercraft by setting the first default angle, the second default angle, and the default thrust ratio as the first target rudder angle, the second target rudder angle, and the target thrust ratio respectively;

detect an actual motion of the watercraft;

when the desired motion is the straight sideways movement but the actual motion of the watercraft includes a bow turning motion, determine a first correcting angle and a second correcting angle so as to reduce the bow turning motion of the watercraft;

when the desired motion is the straight sideways movement but the actual motion of the watercraft includes a back-and-forth movement, determine a correcting thrust ratio so as to reduce the back-and-forth movement of the watercraft;

correct the first target rudder angle, the second target rudder angle, and the target thrust ratio with the first correcting angle, the second correcting angle, and the correcting thrust ratio respectively; and repeatedly detect the actual motion of the watercraft and repeatedly update the first correcting angle, the second correcting angle, and the correcting thrust ratio.

2. The system according to claim 1, wherein the controller is further configured or programmed to:

determine whether or not an operating mode is enabled, the operating mode being executed by operating the operator;

when the operating mode is enabled, continue to detect the actual motion of the watercraft and update the first correcting angle, the second correcting angle, and the correcting thrust ratio; and when the operating mode is disabled, reset the first correcting angle, the second correcting angle, and the correcting thrust ratio to zero.

3. The system according to claim 2, wherein the controller is further configured or programmed to keep the first default angle, the second default angle, the default thrust ratio even when the operating mode is disabled.

4. The system according to claim 1, wherein the controller includes a volatile memory and a non-volatile memory; and the controller is further configured or programmed to:

store the first default angle, the second default angle, and the default thrust ratio in the non-volatile memory; and save the first correcting angle, the second correcting angle, and the correcting thrust ratio in the volatile memory.

5. The system according to claim 1, wherein when the actual motion of the watercraft includes the bow turning motion, the controller is further configured or programmed to:

determine the first correcting angle and the second correcting angle so as to reduce the bow turning motion of the watercraft;

correct the first target rudder angle and the second target rudder angle with the first correcting angle and the second correcting angle respectively; and repeatedly detect the actual motion of the watercraft and repeatedly update the first correcting angle and the second correcting angle.

6. The system according to claim 1, wherein when the actual motion of the watercraft includes the back-and-forth movement, the controller is further configured or programmed to:

determine a correcting thrust ratio so as to reduce the back-and-forth movement of the watercraft;

correct the target thrust ratio with the correcting thrust ratio; and repeatedly detect the actual motion of the watercraft and repeatedly update the correcting thrust ratio.

7. A method of controlling a watercraft including a first marine propulsion device and a second marine propulsion device, the first marine propulsion device being rotatable about a first steering shaft, the second marine propulsion device being rotatable about a second steering shaft, the method comprising:

receiving an operating signal from an operator manually operable to output the operating signal indicating a desired motion of the watercraft;

determining a first target rudder angle of the first marine propulsion device, a second target rudder angle of the second marine propulsion device, and a target thrust ratio in accordance with the operating signal and controlling the first marine propulsion device and the second marine propulsion device based on the first target rudder angle, the second target rudder angle, and the target thrust ratio such that the watercraft performs the desired motion, the target thrust ratio being a ratio of magnitude between a first thrust generated by the first marine propulsion device and a second thrust generated by the second marine propulsion device;

retrieving a first default angle for the first target rudder angle, a second default angle for the second target rudder angle, and a default thrust ratio for the target thrust ratio, the first default angle, the second default angle, and the default thrust ratio being preliminarily set such that a net thrust of the first thrust and the second thrust is oriented straight sideways and extends from a center of gravity of the watercraft;

when the desired motion is straight sideways movement, controlling the first marine propulsion device and the second marine propulsion device to start moving the watercraft by setting the first default angle, the second default angle, and the default thrust ratio as the first target rudder angle, the second target rudder angle, and the target thrust ratio respectively;

detecting an actual motion of the watercraft;

when the desired motion is the straight sideways movement but the actual motion of the watercraft includes a bow turning motion, determining at least one of a first correcting angle and a second correcting angle so as to reduce the bow turning motion of the watercraft;

when the desired motion is the straight sideways movement but the actual motion of the watercraft includes a back-and-forth movement, determining a correcting thrust ratio so as to reduce the back-and-forth movement of the watercraft;

correcting the first target rudder angle, the second target rudder angle, and the target thrust ratio with the first correcting angle, the second correcting angle, and the correcting thrust ratio respectively; and repeatedly detecting the actual motion of the watercraft and repeatedly updating the first correcting angle, the second correcting angle, and the correcting thrust ratio.

8. The method according to claim 7, further comprising:

determining whether or not an operating mode is enabled, the operating mode being executed by operating the operator;

when the operating mode is enabled, continuing to detect the actual motion of the watercraft and update the first correcting angle, the second correcting angle, and the correcting thrust ratio; and when the operating mode is disabled, resetting the first correcting angle, the second correcting angle, and the correcting thrust ratio to zero.

9. The method according to claim 8, further comprising:

keeping the first default angle, the second default angle, and the default thrust ratio even when the operating mode is disabled.

10. The method according to claim 7, wherein the first default angle, the second default angle, and the default thrust ratio are stored in a non-volatile memory, the method further comprising:

saving the first correcting angle, the second correcting angle, and the correcting thrust ratio in a volatile memory.

11. The method according to claim 7, further comprising:

when the actual motion of the watercraft includes the bow turning motion, determining the first correcting angle and the second correcting angle so as to reduce the bow turning motion of the watercraft;

correcting the first target rudder angle and the second target rudder angle with the first correcting angle and the second correcting angle respectively; and repeatedly detecting the actual motion of the watercraft and repeatedly updating the first correcting angle and the second correcting angle.

12. The method according to claim 7, further comprising:

when the actual motion of the watercraft includes the back-and-forth movement, determining a correcting thrust ratio so as to reduce the back-and-forth movement of the watercraft;

correcting the target thrust ratio with the correcting thrust ratio; and repeatedly detecting the actual motion of the watercraft and repeatedly updating the correcting thrust ratio.

13. A system for controlling a watercraft, the system comprising:

a first marine propulsion device rotatable about a first steering shaft;

a second marine propulsion device rotatable about a second steering shaft;

an operator manually operable to output an operating signal indicating a desired motion of the watercraft; and a controller configured or programmed to:

determine a first target rudder angle of the first marine propulsion device, a second target rudder angle of the second marine propulsion device, a first target thrust indicating a target magnitude of a first thrust generated by the first marine propulsion device, and a second target thrust indicating a target magnitude of a second thrust generated by the second marine propulsion device in accordance with the operating signal;

control the first marine propulsion device and the second marine propulsion device based on the first target rudder angle, the second target rudder angle, the first target thrust, and the second target thrust such that the watercraft performs the desired motion;

store a first default angle for the first target rudder angle and a second default angle for the second target rudder angle, the first default angle and the second default angle being preliminarily set such that a net thrust of the first thrust and the second thrust is oriented straight sideways and extends from a center of gravity of the watercraft;

when the desired motion is straight sideways movement, control the first marine propulsion device and the second marine propulsion device to start moving the watercraft by setting the first default angle and the second default angle as the first target rudder angle and the second target rudder angle respectively;

detect an actual motion of the watercraft;

when the desired motion is the straight sideways movement but the actual motion of the watercraft includes a bow turning motion, determine a first correcting angle and a second correcting angle so as to reduce the bow turning motion of the watercraft;

when the desired motion is the straight sideways movement but the actual motion of the watercraft includes a back-and-forth movement, determine a correcting thrust ratio so as to reduce the back-and-forth movement of the watercraft;

correct the first target rudder angle, the second target rudder angle, the first target thrust, and the second target thrust with the first correcting angle, the second correcting angle, the first correcting thrust, and the second correcting thrust respectively; and repeatedly detect the actual motion of the watercraft and repeatedly update the first correcting angle, the second correcting angle, the first correcting thrust, and the second correcting thrust.

14. The system according to claim 13, wherein the controller is further configured or programmed to:

determine whether or not an operating mode is enabled, the operating mode being executed by operating the operator;

when the operating mode is enabled, continue to detect the actual motion of the watercraft and update the first correcting angle, the second correcting angle, the first correcting thrust, and the second correcting thrust; and when the operating mode is disabled, reset the first correcting angle, the second correcting angle, the first correcting thrust, and the second correcting thrust to zero.

15. The system according to claim 14, wherein the controller is further configured or programmed to keep the first default angle and the second default angle even when the operating mode is disabled.

16. The system according to claim 13, wherein the controller includes a volatile memory and a non-volatile memory; and the controller is further configured or programmed to:

store the first default angle and the second default angle in the non-volatile memory; and save the first correcting angle, the second correcting angle, the first correcting thrust, and the second correcting thrust in the volatile memory.

17. The system according to claim 13, wherein when the actual motion of the watercraft includes the bow turning motion, the controller is further configured or programmed to:

determine the first correcting angle and the second correcting angle so as to reduce the bow turning motion of the watercraft;

correct the first target rudder angle and the second target rudder angle with the first correcting angle and the second correcting angle respectively; and repeatedly detect the actual motion of the watercraft and repeatedly update the first correcting angle and the second correcting angle.

18. The system according to claim 13, wherein when the actual motion of the watercraft includes the back-and-forth movement, the controller is further configured or programmed to:

determine the first correcting thrust and the second correcting thrust so as to reduce the back-and-forth movement of the watercraft;

correct the first target thrust with the first correcting thrust;

correct the second target thrust with the second correcting thrust; and repeatedly detect the actual motion of the watercraft and repeatedly update the first correcting thrust and the second correcting thrust.

* * * * *